US007855236B2

(12) United States Patent
Van Hardeveld et al.

(10) Patent No.: US 7,855,236 B2
(45) Date of Patent: Dec. 21, 2010

(54) METHOD TO START A PROCESS FOR PRODUCING HYDROCARBONS FROM SYNTHESIS GAS

(75) Inventors: Robert Martijn Van Hardeveld, Rotterdam (NL); Hans Michiel Huisman, Rotterdam (NL); Lip Piang Kueh, Sarawak (MY); Thomas Joris Remans, Amsterdam (NL)

(73) Assignee: Shell Oil Company, Houston, TX (US)

( * ) Notice: Subject to any disclaimer, the term of this patent is extended or adjusted under 35 U.S.C. 154(b) by 31 days.

(21) Appl. No.: 12/096,412

(22) PCT Filed: Dec. 6, 2006

(86) PCT No.: PCT/EP2006/069354

§ 371 (c)(1),
(2), (4) Date: Jun. 30, 2008

(87) PCT Pub. No.: WO2007/065905

PCT Pub. Date: Jun. 14, 2007

(65) Prior Publication Data

US 2008/0275144 A1 Nov. 6, 2008

(30) Foreign Application Priority Data

Dec. 9, 2005 (EP) ..... 05111870

(51) Int. Cl.
*C07C 27/00* (2006.01)

(52) U.S. Cl. ..... 518/706

(58) Field of Classification Search ..... 518/706
See application file for complete search history.

(56) References Cited

U.S. PATENT DOCUMENTS

| | | | | |
|---|---|---|---|---|
| 2,602,810 A | | 7/1952 | Montgomery et al. | 260/449.6 |
| 2,610,976 A | | 9/1952 | Martin et al. | 260/449.6 |
| 2,904,576 A | | 9/1959 | McGrath | 260/449.6 |
| 4,127,392 A | * | 11/1978 | Watson et al. | 48/197 R |
| 4,626,552 A | | 12/1986 | Arcuri | 518/712 |
| 5,763,716 A | | 6/1998 | Benham et al. | 585/315 |
| 2004/0077736 A1 | | 4/2004 | Steynberg | 518/703 |
| 2005/0027020 A1 | | 2/2005 | Steynberg | 518/718 |

FOREIGN PATENT DOCUMENTS

| | | |
|---|---|---|
| EP | 0152652 | 8/1985 |
| GB | 845558 | 8/1960 |
| WO | WO 9306041 | 4/1993 |
| WO | WO 9717137 | 5/1997 |
| WO | WO 9961550 | 12/1999 |
| WO | WO 02059232 | 8/2002 |
| WO | WO 03068715 | 8/2003 |
| WO | WO 2004015028 | 2/2004 |
| WO | WO 2004026994 | 4/2004 |
| WO | WO 2005026292 | 3/2005 |
| WO | WO 2005026293 | 3/2005 |

OTHER PUBLICATIONS

Oil and Gas Journal, Sep. 6, 1971, pp. 86-90.

* cited by examiner

*Primary Examiner*—Jafar Parsa
*Assistant Examiner*—Yate K Cutliff

(57) ABSTRACT

Method to start a steady state process for producing normally gaseous, normally liquid and optionally normally solid hydrocarbons from synthesis gas, which process comprises the steps of: (i) providing the synthesis gas; and (ii) catalytically converting the synthesis gas at an elevated temperature and a steady state total reactor pressure to obtain the normally gaseous, normally liquid and optionally normally solid hydrocarbons; the method comprising admixing the synthesis gas of step (i) with one or more inert gases to form an admixture stream prior to catalytically converting the synthesis gas in step (ii) at the steady state total reactor pressure and wherein as the activity of the catalyst converting the synthesis gas proceeds towards a steady state, the amount of inert gas(es) in the admixture stream is reduced.

18 Claims, No Drawings

METHOD TO START A PROCESS FOR PRODUCING HYDROCARBONS FROM SYNTHESIS GAS

The present application claims priority to European Patent Application 05111870.1 filed 9 Dec. 2005.

FIELD OF THE INVENTION

The present invention provides a method to start a steady state catalytic process for producing normally gaseous, normally liquid and optionally solid hydrocarbons from synthesis gas, generally provided from a hydrocarbonaceous feed, for example a Fischer-Tropsch process. In particular the present invention provides a method to start an integrated, low cost process for the production of hydrocarbons, especially normally liquid hydrocarbons, from natural gas or associated gas, in particular at remote locations as well as at off-shore platforms. The invention further provides a process for producing normally gaseous, normally liquid and optionally normally solid hydrocarbons from synthesis gas using such method and hydrocarbons whenever provided by such process.

BACKGROUND OF THE INVENTION

Many documents are known describing processes for the catalytic conversion of (gaseous) hydrocarbonaceous feedstocks, especially methane, natural gas and/or associated gas, into liquid products, especially methanol and liquid hydrocarbons, particularly paraffinic hydrocarbons. In this respect often reference is made to remote locations and/or off-shore locations, where no direct use of the gas is possible. Transportation of the gas, e.g. through a pipeline or in the form of liquefied natural gas, is not always practical. This holds even more in the case of relatively small gas production rates and/or fields. Reinjection of gas will add to the costs of oil production, and may, in the case of associated gas, result in undesired effects on the crude oil production. Burning of associated gas has become an undesired option in view of depletion of hydrocarbon sources and air pollution.

The Fischer-Tropsch process can be used for the conversion of hydrocarbonaceous feed stocks into liquid and/or solid hydrocarbons. Generally, the feed stock (e.g. natural gas, associated gas and/or coal-bed methane, coal, biomass, as well as residual (crude) oil fractions) is converted in a first step into a mixture of hydrogen and carbon monoxide (this mixture is often referred to as synthesis gas or syngas). The synthesis gas is then fed into a reactor where it is converted in one or more steps over a suitable catalyst at elevated temperature and pressure into paraffinic compounds ranging from methane to high molecular weight compounds comprising up to 200 carbon atoms, or, under particular circumstances, even more.

Numerous types of reactor systems have been developed for carrying out the Fischer-Tropsch reaction. For example, Fischer-Tropsch reactor systems include fixed bed reactors, especially multi-tubular fixed bed reactors, fluidised bed reactors, such as entrained fluidised bed reactors and fixed fluidised bed reactors, and slurry bed reactors such as three-phase slurry bubble columns and ebullating bed reactors.

The Fischer-Tropsch reaction is very exothermic and temperature sensitive, with the result that careful temperature control is required to maintain optimum operation conditions and desired hydrocarbon product selectivity. Indeed, close temperature control and operation throughout the reactor are major objectives.

Starting up such a process will involve new or regenerated catalyst material. However, catalyst material when new or regenerated is often more active than once it has achieved a steady state activity under reaction conditions. In chemical reactions such as the Fischer-Tropsch reaction, which is very exothermic and temperature sensitive as mentioned above, a higher level of activity of a catalyst at the start-up of a reactor is of significant concern. In a Fischer-Tropsch reaction, the higher activity can easily result in over-conversion that may result in undesired catalyst de-activation, for example due to higher water production or due to carbonation of the catalyst as a result of a decreased hydrogen-to-carbon monoxide ratio in the synthesis gas.

There is thus required a way of using the initial greater activity of new catalyst material until the reaction process reaches a steady state. In the prior art, the start-up of a Fischer-Tropsch reactor is typically performed at a lower temperature and/or pressure than the steady state temperature and/or pressure of such reactor in order to prevent over-conversion and its undesired effects.

In U.S. Pat. No. 2,904,576 for example is disclosed a starting-up procedure for a process for hydrocarbon synthesis from synthesis gas using a fluidised iron catalyst. The initial activity of the catalyst is modified by contacting the catalyst with synthesis gas at a relatively low pressure, i.e. not over 5 atmospheres, and a low space velocity. The pressure and space velocity are gradually increased as the catalyst activity decreases until a pressure and space velocity for effecting the hydrocarbon synthesis reaction are reached.

In WO 2005/026292 and Wo 2005/026293 is disclosed a method for start-up of a hydrocarbon synthesis process in a slurry bubble column. The start-up method comprises a specific procedure for charging the catalyst particles in the conversion reactor. At the end of the charging phase, the reactor is kept at a temperature ranging from 150 to 220° C. and a pressure ranging from 1 to 10 bar and is continuously fed with inert gas to prevent catalyst sedimentation. During a conditioning phase, the temperature is brought to values suitable for conditioning, the inert gas is gradually substituted by synthesis gas up to a concentration ranging from 5-50 vol % and this concentration is maintained for 24-72 hours. Then, the pressure and temperature are gradually increased up to steady state regime values and the concentration of inert gas gradually reduced to zero.

A reduced reaction temperature during start-up disadvantageously reduces the quality, in particular the pressure, of the steam produced in the cool water system of the hydrocarbon synthesis reactor during start-up. Low quality steam cannot be used to assist in either providing start-up energy or power for one or more other reactions or processes, or as feed material for same, or both. Therefore, it is desired to minimise the period of time for the start-up of a catalytic conversion reactor before it is at a suitable temperature for producing steam of sufficient quality which is usable in other parts of the process, or other (preferably integral) apparatus or units involved with the process.

A reduced pressure during start-up is a disadvantage in a process line-up of several hydrocarbon synthesis reactors, parallel or in series, connected to a common recycle system. If it is desired to start-up one or more of the reactors whereas the other reactors operate under steady state conditions, it is not desirable to start-up under reduced pressure conditions.

SUMMARY OF THE INVENTION

A novel start-up method has been found that overcomes the above-mentioned disadvantages.

According, the present invention provides a method to start a steady state process for producing normally gaseous, normally liquid and optionally normally solid hydrocarbons from synthesis gas, which process comprises the steps of:

(i) providing the synthesis gas; and (ii) catalytically converting the synthesis gas at an elevated temperature and a steady state total reactor pressure to obtain the normally gaseous, normally liquid and optionally normally solid hydrocarbons; the method comprising admixing the synthesis gas of step (i) with one or more inert gases to form an admixture stream prior to catalytically converting the synthesis gas in step (ii) at the steady state total reactor pressure and wherein as the activity of the catalyst converting the synthesis gas proceeds towards a steady state, the amount of inert gas(es) in the admixture stream is reduced.

In the method according to the invention, the total reactor pressure in the conversion reactor is kept wholly or substantially constant (that is generally 5%, preferably within 2%) during the start-up or initial period, i.e. the period until the activity of the catalyst in the conversion reactor has reached a steady state. The total reactor pressure during the start-up period is wholly or substantially the same (that is within 5%, preferably within 2%) as the steady state total reactor pressure, i.e. the total reactor pressure at which the process is operated after the start-up period.

With the addition of one or more inert gases, the synthesis gas pressure only has a partial pressure in the admixture stream which is catalytically converted in the start-up method. This reduces the over-conversion that would otherwise occur by use of full synthesis gas pressure acting on new or regenerated catalyst material.

Thus, the present invention simulates the catalytic carbon monoxide conversion in the reactor at steady state conditions, i.e. the "normalised catalytic conversion", after the initial greater activity period of the new or regenerated catalyst.

Moreover, by using a lower initial partial pressure of synthesis gas in the reactor, no lowering of reaction temperature, to otherwise compensate for the initial greater activity of the catalyst, is required. Thus, high quality steam is produced and the period during which this is not yet produced is minimised. Moreover, a relatively high temperature has a positive effect on preventing water condensation in the reactor.

A further advantage of the start-up method according to the invention is that the start-up is carried out at the same total reactor pressure as the steady state total reactor pressure. This means that this start-up method can advantageously be used in a process line-up of several hydrocarbon synthesis reactors, parallel or in series, that are connected to a common recycle system. Start-up of one or more reactors in such line-up whereas the other reactors operate under steady state conditions is possible with the start-up method according to the invention.

By using a lower initial partial pressure of synthesis gas in the conversion reactor, there will also be a lower partial pressure of water.

The present invention also provides a process for producing normally gaseous, normally liquid and optionally normally solid hydrocarbons from synthesis gas using a method hereindescribed, as well as hydrocarbons whenever provided by such a process.

DETAILED DESCRIPTION OF THE INVENTION

In the method according to the invention, a steady state hydrocarbon synthesis process is started by admixing synthesis gas that is provided in step (i) of the process with one or more inert gases to form an admixture stream. The admixture stream is then contacted with a hydrocarbon synthesis catalyst for conversion of the synthesis gas in step (ii) of the process at the steady state total reactor pressure. As, during start-up, the activity of the catalyst converting the synthesis gas proceeds towards a steady state, i.e. the activity decreases, the amount of inert gas(es) in the admixture stream is reduced.

Thus, in the method according to the invention, the lower initial partial pressure of the synthesis gas is increased as the process for producing normally gaseous, normally liquid and optionally normally solid hydrocarbons proceeds towards a steady state. This is achieved by reduction of the amount of inert gas(es) in the admixture stream, which reduction is preferably to zero, either incrementally, continuously, or a combination of the two.

As the activity of the catalyst decreases in the start-up or initial period towards a steady state activity, the partial pressure of the synthesis gas could be increased in a number of stages, but at least in a way wherein its partial pressure is kept close to, preferably below, the expected pressure of synthesis gas in the reactor for steady state catalytic conversion.

In the method according to the invention, the catalytic hydrocarbon synthesis step during start-up is carried out in the same conversion reactor as the steady state catalytic hydrocarbon synthesis step.

The term "steady state" as used herein is a term well known in the art, and relates to a constant or regular, relative to the matter involved, value or position over a period of time. Minor variation in all chemical reactions is common even for a steady state process, but a steady state process is well known in the art wherein the expected output or result is relatively predictable over time. Such conditions may or may not also be optimal, or to provide optimum results.

Another definition of "steady state" relates to the overall and individual conditions, including pressures and temperatures, of the hydrocarbon synthesis plant design. Such conditions are fundamental conditions set for the plant, and their selection would be known to a person skilled in the art.

The term "steady state" is similarly used herein in relation to pressure and temperature and catalyst activity. In a conversion reactor, pressure is usually related to that at the top of the reactor.

In relation to catalyst activity, new or regenerated catalyst when first used can have as much as 70% or higher greater activity of the expected or design or steady state activity. This heightened activity naturally reduces as the catalyst is used from the start-up. Thus, the initial catalyst activity can be in the range 120-170%, preferably in the range 135-140%, of the steady state catalyst activity.

The initial synthesis gas partial pressure in the conversion reactor could be any suitable pressure lower than the total reactor pressure which suits other start-up conditions, or the reactor conditions and/or products being provided by such reactor. The initial partial pressure of the synthesis gas in a conversion reactor could be 20-70% lower than the usual steady state total reactor pressure, preferably 30-60% lower.

The actual flow rate of synthesis gas entering the synthesis reactor preferably does not change or significantly change during this initial period, but its partial pressure will be such as to simulate as near as possible the normal or steady state space time yield. Thus, the partial pressure of the synthesis gas entering the conversion reactor during start-up is preferably controlled such that the space time yield of a conversion reactor during the initial or start-up phase is kept at the same value as during steady state operation. Space time yield expresses the yield as weight of $C_1$+ hydrocarbons produced per reactor volume per hour.

The amount of inert gas(es) in the admixture stream during start-up could be in the range >0-99%, preferably 20-80%, more preferably 30-70%, and even more preferably 40-60%, of the combination of the inert gas(es) and the synthesis gas of step (i).

The one or more inert gases could be one or more selected from the group comprising: methane, nitrogen, ethane, propane, carbon dioxide, off gas from the process for producing hydrocarbons or post-conversion reactor gas from step (ii), preferably selected from the group comprising methane, off gas and post-conversion reactor gas.

The term "inert gas" as used herein can be 100% inert in itself for a Fischer-Tropsch process or reaction. The term also covers a gas stream containing one or more such inert gases. Examples of such streams are off gas from the process for producing hydrocarbons or post-conversion reactor gas from step (ii), which gas streams can include one or more gases that are inert for a Fischer-Tropsch process.

The method of the present invention is particularly suitable for processes involving more than one hydrocarbon conversion reactor, optionally 2-10 reactors. Such reactors may be in an arrangement or system with one or more other conversion reactors. In the method of the present invention, at least the conversion reactor(s) to which the invention applies are preferably connected, either in parallel, in series, or both.

In the present invention, the method of using a lower initial synthesis gas pressure in a reactor is preferably used in all the conversion reactors to which the invention applies. The method could be applied to each conversion reactor in a simultaneous manner. This arrangement may be suitable where the catalyst in the conversion reactor(s) is pre-activated, and does not require activation in situ.

In a preferred embodiment of the present invention, each conversion reactor to which the invention applies is started at a different time. In one way, the method is therefore applied sequentially to each relevant conversion reactor. This arrangement may be suitable where, each conversion reactor undergoes catalyst activation in situ. This arrangement is particularly suitable where resources are only able or only suitable for providing catalyst activation of one or two conversion reactors at a time.

Generally, a conversion reactor takes a number of weeks from its start-up before it reaches a steady state. Such period can be in the range 1-8 weeks or longer, more usually 2-5 weeks. Where the arrangement is for applying the method the present invention to a number of conversion reactors sequentially, then there will be a cumulative time period before all the conversion reactors have reached a steady state, such that the initial lower pressure of the synthesis gas can then be raised in all the conversion reactors to the steady state total reactor pressure.

In the present invention, one or more of the conversion reactors involved in the method of the present invention could have a gas product recycle system or arrangement, more preferably the conversion reactors have a common gas recycle. With a common recycle, preferably all the conversion reactors to which the method applies have the same total reactor pressure.

Since in the method according to the invention the total reactor pressure during start-up is essentially the same as during steady state operation, gas may be recycled during start-up via such common recycle, even if at least one other reactor operates in steady state. In an alternative embodiment, any recycle material made by the or each conversion reactor started by the present method is initially either not recycled or flared off.

The present invention is particularly suitable for integrated processes. One other usual product of the Fischer-Tropsch reaction is the provision of steam, and one further effect of the present invention is to provide in minimal time steam of sufficient quality for use in other parts of the process, or ancillary or other connected processes, units or apparatus, such as an air separation unit (ASU). Such an ASU may for example be used to provide oxygen-enriched air or substantially pure oxygen for the partial oxidation of a hydrocarbonaceous feedstock in order to provide synthesis gas (step (i) of the process for producing hydrocarbons). ASUs are often powered by steam-driven turbines, which generally require steam of sufficient quality, generally pressure, as a power source.

Preferably, the initial temperature for the catalytic conversion of the synthesis gas, i.e. the temperature at start-up, is wholly or substantially the same as the plant design, or steady state, temperature. At conditions of a high steady state total reactor pressure, for example 45 bar (absolute) or higher, and thus also a high total reactor pressure at start-up, it may be advantageous to start the method with an initial temperature that is lower than the plant design or steady state temperature in order to avoid over-conversion. The temperature could then be adjusted to the steady state temperature as soon as the catalyst activity is decreased to such level that over-conversion does not occur under the prevailing total reactor pressure and synthesis gas partial pressure. If a lower initial temperature is used in any of the conversion reactors, the initial temperature may be in the range >0-30° C. lower than the steady state temperature, preferably 5-15° C. lower.

Preferably, the temperature regime used in each conversion reactor to which the method of the present invention applies is wholly or substantially the same or similar. Also preferably, the or each conversion reactor to which the invention applies has the same space time yield (STY).

As mentioned above, the space time yield of a reactor during the initial or start-up phase is preferably kept at the same value as the space time yield of a reactor during steady state operation.

Where the catalytic conversion of synthesis gas in step (ii) provides steam, the present invention includes the provision of using the steam obtained in step (ii)) for generating power in the providing of the synthesis gas for step (i), once the temperature is approximately the same as or above the steady state temperature.

As mentioned above, the process to which the present start-up invention applies could involve a number of conversion reactors. In one embodiment, the process for producing hydrocarbons by catalytically converting synthesis gas could be used in at least three, preferably 4 to 15, more preferably 6 to 10 conversion reactors, and not all of the conversion reactors, optionally between 25-75% of the reactors, preferably between 40-60% of the reactors, use the method to start with a lower initial pressure of synthesis gas for step (ii).

In such a situation, the process for producing hydrocarbons in at least one of the remaining conversion reactors for step (ii) could already be operating such that the method of the present invention is to bring into operation one or more further catalytically converting reactors.

In step (i) of the process of producing hydrocarbons, synthesis gas is provided. The synthesis gas may be provided by any suitable means, process or arrangement. This includes partial oxidation and/or reforming of a hydrocarbonaceous feedstock as is known in the art. The hydrocarbonaceous feedstock may be a gaseous or solid feedstock. Suitable solid feedstocks are for example coal and biomass, preferably lignocellulosic biomass. Suitable gaseous feedstocks are known in the art and include natural gas, associated gas, methane or a mixture of $C_1$-$C_4$ hydrocarbons. The partial oxidation of gaseous feedstocks, producing a gaseous mixture comprising carbon monoxide and hydrogen, can take place according to various established processes. These processes include the Shell Gasification Process. A comprehensive survey of this process can be found in the Oil and Gas Journal, Sep. 6, 1971, pp 86-90.

The $H_2$/CO molar ratio of the synthesis gas that is provided in step (i) is suitably between 1.5 and 2.3, preferably between 1.8 and 2.1. If desired, additional hydrogen may be added to synthesis gas produced via partial oxidation or reforming in order to obtain the desired $H_2$/CO molar ratio. Such additional hydrogen may be made by steam methane reforming, preferably in combination with the water gas shift reaction. Any carbon monoxide and carbon dioxide produced together with the hydrogen in such steam methane reforming step may be used in the hydrocarbon synthesis reaction or recycled to increase the carbon efficiency.

If the synthesis gas is provided by partial oxidation of a hydrocarbonaceous feedstock, a molecular oxygen containing gas is needed for the partial oxidation of the feedstock. This molecular oxygen containing gas can be air, oxygen enriched air, or substantially pure air. Production of oxygen or oxygen enriched air typically involves air compression and air separation, usually via cryogenic techniques but a membrane based process could also be used, e.g. the process as described in WO 93/06041. A turbine usually provides the power for driving at least one air compressor or separator of the air compression/separating unit. If necessary, an additional compressing unit may be used between the air separation process and the provision of synthesis gas (step (i)). The turbine and/or the optional additional compressing unit are preferably driven by steam generated in step (ii).

The steady state catalytic synthesis gas conversion process may be performed under conventional synthesis conditions known in the art. Typically, the catalytic conversion may be effected at a temperature in the range of from 100 to 600° C., preferably from 150 to 350° C., more preferably from 180 to 270° C. Typical total reactor pressures for the catalytic conversion process are in the range of from 1 to 200 bar absolute, more preferably from 10 to 100 bar absolute, even more preferable from 20 to 70 bar absolute.

Catalysts used in step (ii) of the process for producing hydrocarbons are known in the art and are usually referred to as Fischer-Tropsch catalysts. Catalysts for use in the Fischer-Tropsch hydrocarbon synthesis process frequently comprise, as the catalytically active component, a metal from Group VIII of the previous IUPAC version of the Periodic Table of Elements such as that described in the 68$^{th}$ Edition of the Handbook of Chemistry and Physics (CPC Press). Particular catalytically active metals include ruthenium, iron, cobalt and nickel. Cobalt is a preferred catalytically active metal.

It depends on the catalyst and the process conditions used in a Fischer-Tropsch reaction which hydrocarbon products are obtained. Preferably, a Fischer-Tropsch catalyst is used, which yields substantial quantities of paraffins, more preferably substantially unbranched paraffins. A most suitable catalyst for this purpose is a cobalt-containing Fischer-Tropsch catalyst.

The hydrocarbons produced in the process mentioned in the present description are suitably $C_{3-200}$ hydrocarbons, more suitably $C_{4-150}$ hydrocarbons, especially $C_{5-100}$ hydrocarbons, or mixtures thereof. These hydrocarbons or mixtures thereof are liquid or solid at temperatures between 5 and 30° C. (1 bar), especially at about 20° C. (1 bar), and usually are paraffinic of nature, while up to 30 wt %, preferably up to 15 wt %, of either olefins or oxygenated compounds may be present. Typically, mainly (at least 70 wt %, preferably 90 wt %) of $C_5$+ hydrocarbons are formed.

A part of the hydrocarbons produced in step (ii) may boil above the boiling point range of the so-called middle distillates. The higher boiling range paraffinic hydrocarbons, if present, may be isolated and subjected to a catalytic hydrocracking step, which is known per se in the art, to yield the desired middle distillates. Therefore, the hydrocarbon synthesis process to which the start-up method according to the invention is applied preferably further comprises:

step (iii) catalytically hydrocracking higher boiling range paraffinic hydrocarbons produced in step (ii).

The catalytic hydrocracking is carried out by contacting the paraffinic hydrocarbons at elevated temperature and pressure and in the presence of hydrogen with a catalyst containing one or more metals having hydrogenation activity, and supported on a carrier with tailored acidity. Suitable hydrocracking catalysts are known in the art and include catalysts comprising metals selected from Groups VIB and VIII of the (same) Periodic Table of Elements. Preferably, the hydrocracking catalysts contain one or more noble metals from Group VIII. Preferred noble metals are platinum, palladium, rhodium, ruthenium, iridium and osmium. Most preferred catalysts for use in the hydrocracking stage are those comprising platinum. The amount of catalytically active metal present in the hydrocracking catalyst may vary within wide limits and is typically in the range of from about 0.05 to about 5 parts by weight per 100 parts by weight of the carrier material.

Suitable conditions for the catalytic hydrocracking are known in the art. Typically, the hydrocracking is effected at a temperature in the range of from about 175 to 400° C. Typical hydrogen partial pressures applied in the hydrocracking process are in the range of from 10 to 250 bar.

The hydrocarbon synthesis process may be operated in a single pass mode ("once through") or in a recycle mode. As mentioned before, the process may be carried out in one or more reactors, either parallel or in series. Slurry bed reactors, ebullating bed reactors and fixed bed reactors may be used, the fixed bed reactor being the preferred option, although the method of the present invention is also particularly suitable for a Fischer-Tropsch plant using one or more slurry bed reactors, as it is important in slurry bed reactors to minimise disturbances and variations in pressure used in such reactors.

Any percentage mentioned in this description is calculated on total weight or volume of the composition, unless indicated differently. When not mentioned, percentages are considered to be weight percentages. Pressures are indicated in bar absolute, unless indicated differently.

What is claimed is:

1. A method to start a steady state process for producing normally gaseous, normally liquid and optionally normally solid hydrocarbons from synthesis gas, which process comprises the steps of:

(i) providing the synthesis gas; and (ii) catalytically converting the synthesis gas at an elevated temperature and a steady state total reactor pressure to obtain the normally gaseous, normally liquid and optionally normally solid hydrocarbons;

the method comprising admixing the synthesis gas of step (i) with one or more inert gases to form an admixture stream prior to catalytically converting the synthesis gas in step (ii) at the steady state total reactor pressure and wherein as the activity of the catalyst converting the synthesis gas proceeds from start-up towards a steady state, the amount of inert gas(es) in the admixture stream is reduced over a period of up to eight weeks.

2. The method as claimed in claim 1 wherein the one or more inert gases is selected from the group consisting of methane, nitrogen, ethane, propane, off gas and post-conversion reactor syngas, off gas and/or post-conversion reactor syngas and mixtures thereof.

3. The method as claimed in claim 1 wherein the initial amount of inert gas(es) in the admixture stream is in the range 20-80% of the combination of the inert gas(es) and the synthesis gas of step (ii).

4. The method as claimed in claim 1 wherein step (ii) is carried out in at least two conversion reactors.

5. The method as claimed in claim 4 wherein the admixture stream is used in more than one of the conversion reactors.

6. The method as claimed in claim 5 wherein the admixture stream is used in all of the conversion reactors.

7. The method as claimed in claim 4 wherein each conversion reactor is started sequentially.

8. The method as claimed in claim 1 wherein as the activity of the catalyst converting the synthesis gas proceeds towards a steady state, the amount of inert gas(es) in the admixture stream is reduced to zero, either incrementally, continuously or a combination thereof.

9. The method as claimed in claim 1 wherein an initial partial pressure of the synthesis gas in the admixture stream is in the range of from 30-60% lower than the total reactor pressure.

10. The method as claimed in claim 4 wherein all the conversion reactors have a common gas recycle system.

11. The method as claimed in claim 10 wherein the recycle system is open for one or more of the conversion reactors when the method starts.

12. The method as claimed in claim 1 wherein the activity of the catalyst in step (ii) at start-up is 120-170%, of the steady state catalyst activity.

13. The method as claimed in claim 1 wherein any steam obtained in step (ii) is used for generating power in the providing of the synthesis gas for step (i).

14. The method as claimed in claim 5 wherein step (ii) is carried out in at least 3 conversion reactors, wherein the method to start with an admixture stream of synthesis gas and one or more inert gases is used in at least two but not all of the conversion reactors, and the method to start with an admixture stream is not used in the remaining conversion reactors.

15. The method as claimed in claim 14 wherein one or more of the remaining conversion reactors are already catalytically converting synthesis gas.

16. The method according to claim 1 wherein the steady state total reactor pressure is in the range of from 10 to 100 bar (absolute).

17. The method according to claim 1 wherein step (ii) is carried out in one or more fixed bed conversion reactors.

18. The method as claimed in claim 1 wherein the process further comprises:

step (iii) catalytically hydrocracking higher boiling range paraffinic hydrocarbons produced in step (ii).

* * * * *